United States Patent [19]

LaForet et al.

[11] Patent Number: 5,016,605

[45] Date of Patent: May 21, 1991

[54] STEAM-OPERATED AND/OR GAS-OPERATED FURNACE

[75] Inventors: Jean LaForet, Cachan; André Rigaud, Bry-Sur-Marne, both of France

[73] Assignee: Gaz de France, France

[21] Appl. No.: 549,807

[22] Filed: Jul. 9, 1990

[30] Foreign Application Priority Data

Jul. 19, 1989 [FR] France ..... 89 09726

[51] Int. Cl.[5] ..... A21B 1/08

[52] U.S. Cl. ..... 126/20; 126/21 A; 126/39 R; 99/447

[58] Field of Search ..... 126/19 R, 19.5, 20, 126/21 R, 21 A, 273 R, 275; 432/176, 199; 99/473, 474, 330, 337, 476; 431/354

[56] References Cited

U.S. PATENT DOCUMENTS

| | | | |
|---|---|---|---|
| 2,524,272 | 10/1950 | Sage | 126/273 R |
| 3,991,737 | 11/1976 | Del Fabbro | 126/21 A |
| 4,418,456 | 12/1983 | Riehl | 431/354 |
| 4,671,250 | 6/1987 | Hurley et al. | 126/21 A |
| 4,823,766 | 4/1989 | Violi | 126/20 |

FOREIGN PATENT DOCUMENTS

| | | | |
|---|---|---|---|
| 277888 | 8/1988 | European Pat. Off. . | |
| 2952398 | 5/1982 | Fed. Rep. of Germany | 126/21 A |
| 2091783 | 5/1971 | France . | |
| 1439971 | 6/1976 | United Kingdom | 126/20 |

*Primary Examiner*—James C. Yeung

*Attorney, Agent, or Firm*—Ostrolenk, Faber, Gerb & Soffen

[57] ABSTRACT

A furnace operating with steam and/or gas for cooking foodstuffs and comprising an enclosure containing on the one hand a gas burner connected to a system for supplying a mixture of gas and of combustion air under pressure which is mounted in the upper portion of the enclosure in an inverted downwards directed position and on the other hand a turbine for stirring the heated atmosphere within the enclosure.

4 Claims, 2 Drawing Sheets

FIG. 1
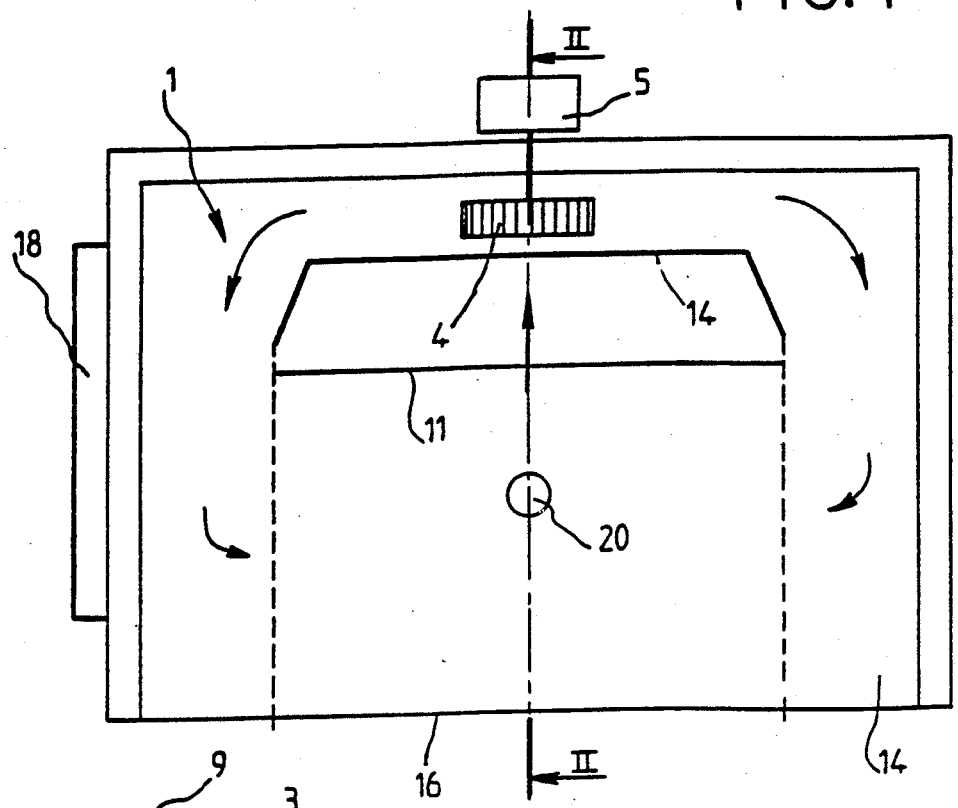
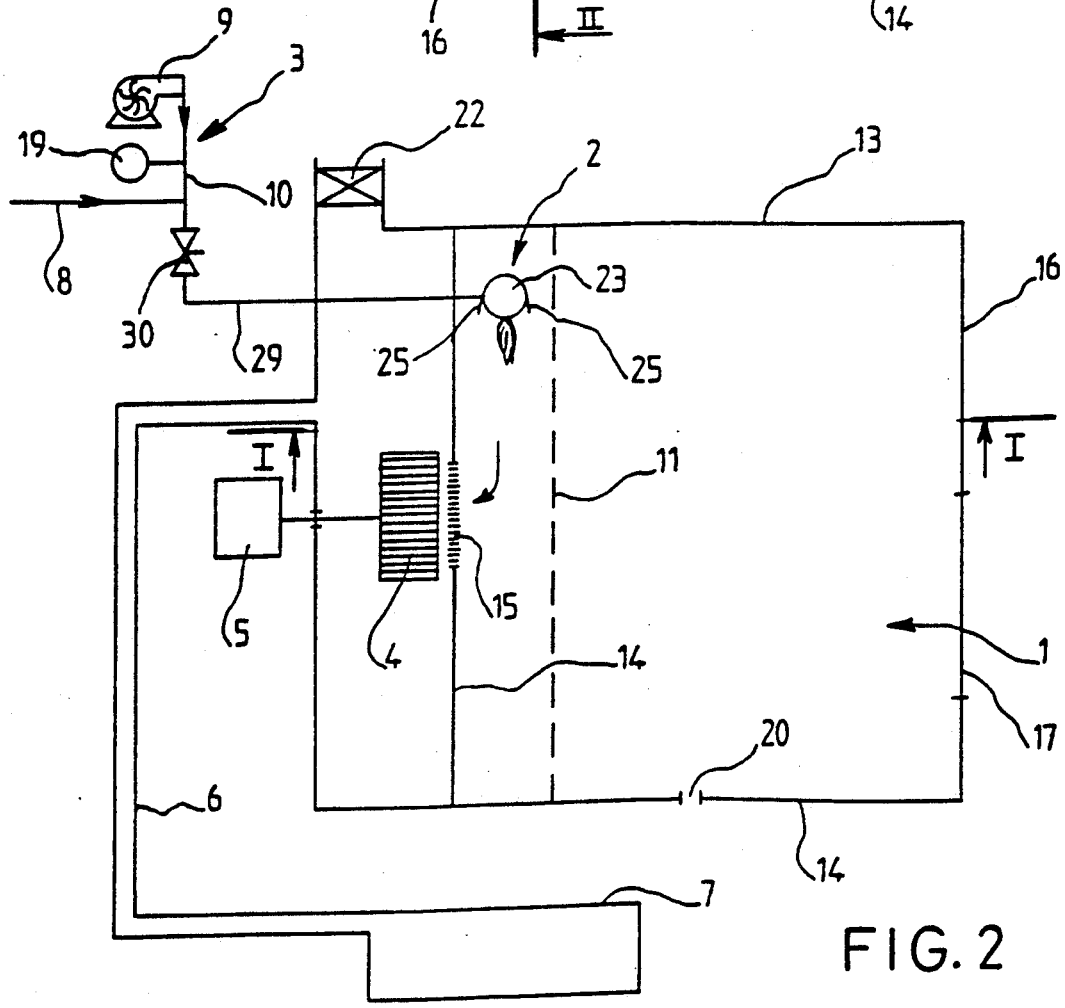
FIG. 2

STEAM-OPERATED AND/OR GAS-OPERATED FURNACE

The present invention relates essentially to an improved furnace which operates with steam and/or gas and which is intended in particular for the cooking of food products.

There are already known steam- and gas-operated furnances essentially comprising a heat insulated enclosure containing on the one hand a gas burner connected to a system for supplying a mixture of gas and of combustion air under pressure and on the other hand a turbine providing for the mixing or stirring of the heated atmosphere within the enclosure.

The latter is also connected to a steam generator so that the furnace enclosure may be heated either by steam or by the burner or by both.

In these furnaces with forced convection however when the enclosure is heated by steam, water would reach the burner and stagnate therein, thereby being likely to cause damages. This is due to the fact that the fan feeding combustion air to the burner does not supply a sufficient counter-pressure likely to cause the steam to be discharged or exhausted towards the outside through the medium of the burner.

Moreover the gas burner would be filled up with water in particular in the case of a cleaning of the furnace.

At last in this kind of furnace the burner is fitted and ceramic plates forming the flame-retaining surface and these plates do not withstand moisture and sudden variations and hygrometry.

The object of the present invention is therefore to cope with all these inconveniences by providing an improved furnace with a burner location and concept or design which are such that this burner does not incur any risk or being damaged by moisture or humidity and retains an outstanding operating reliability even for a long time and whatever the mode of furnace operation might be.

For this purpose the invention is directed to an improved steam-operated and/or gas-operated furnace adapted in particular for cooking food products and of the type essentially comprising an enclosure containing on the one hand at least one gas burner connected to a system for supplying a mixture of gas and of combustion air under pressure and on the other hand a turbine for stirring the heated atmosphere within the enclosure, which enclosure is connected to a steam generator, characterized in that said burner is mounted at the upper portion of the enclosure in a downward turned position pointing towards the bottom of the enclosure in order that the condensates and/or the water projections within the enclosure do not affect the burner.

According to another characterizing feature of this furnace the burner consists of a tube secured to the top wall or ceiling of the enclosure and provided with a plurality of slots which extend at right angles to the center line aixs of the tube.

It should further be specified here that the tube is provided outside with at least two deflectors secured to the bases of the slots for piloting the flames of the burner whereas a preforated flame-distributing metal sheet extends inside of the tube along a plane which is substantially orthogonal to those of the deflectors.

According to still another characterizing feature of the furnace of this invention the enclosure is provided inside with a deflecting metal sheet extending between the upper and lower portions of the enclosure and interposed between the burner and the turbine.

This deflecting metal sheet is provided with a grid at the turbine.

According to still a further characterizing feature of the invention the mixture of gas and of combustion air under pressure is conveyed to the burner by a duct of pipeline fitted with a quarter turn valve controlled by a servo-motor and which advantageously prevents any migration of humidity towards the system for feeding the burner with the gas-combustion air mixture.

BRIEF DESCRIPTION OF THE DRAWINGS

The invention will be better understood and further objects, advantages, details and characterizing features of the invention will appear more clearly as the following explanatory description proceeds with reference to the accompanying diagrammatic drawings given by way of non limiting example only illustrating a presently preferred specific embodiment of the invention and wherein:

FIG. 1 is a diagrammatic top view of a furnace according to this invention seen along the line I—I of FIG. 2;

FIG. 2 is a diagrammatic view of the furnace in section taken upon the line II—II of FIG. 1;

DETAILED DESCRIPTION OF THE PREFERRED EMBODIMENTS

Figure 3:
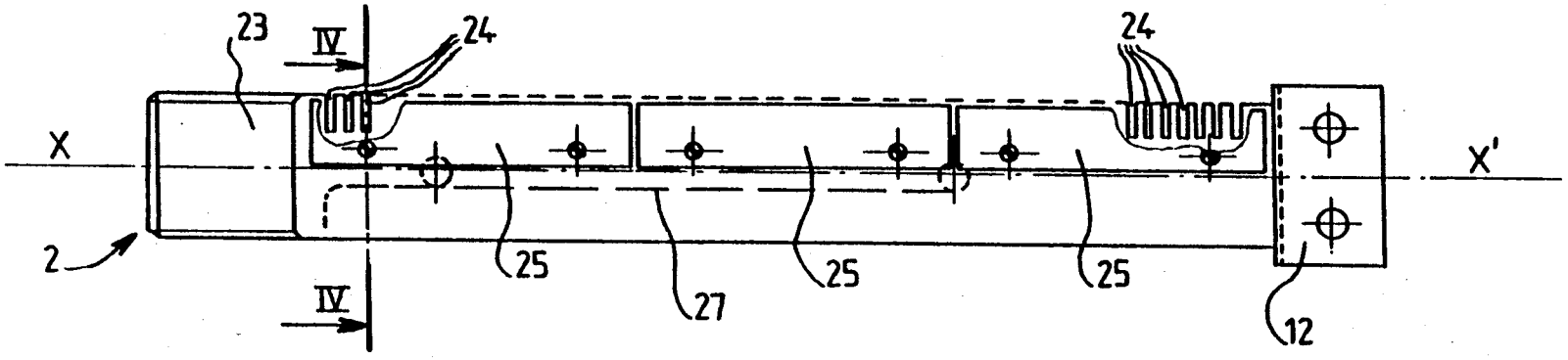
FIG. 3 is a side view of the burner with parts broken away.

Referring in particular to FIGS. 1 and 2 there is seen a furnace consisting essentially of an enclosure 1 which contains a gas burner 2 connected to a system 3 for supplying a mixture of gas and of combustion air under pressure.

The enclosure 1 also contains a turbine 4 driven by a motor 5.

Moreover the enclosure as well seen on FIG. 2 is connected by a pipeline 6 to a steam generator diagrammatically shown at 7.

The system 3 for supplying the burner 2 with a mixture of gas and combustion air comprises in particular a gas feeding duct 8 and a fan 9 adapted to convey through the duct 10 air under pressure blended with gas towards said burner 2.

At 11 is shown a grid for the protection against fats or the like originating from the cooking of the foodstuffs within the enclosure.

According to the invention and as well seen on FIG. 2 the burner 2 is mounted in the upper part of the enclosure 1 in a reversed or downward turned position pointing towards the bottom of this enclosure so that the flames themselves be also directed downwards of the enclosure.

This burner as seen on FIG. 3 may be secured by one or several fastening lugs or tabs such as 12 for instance onto the top wall or ceiling 13 (FIG. 2) of the furnace.

At 14 is shown on FIGS. 1 and 2 a deflecting metal sheet extending between the walls of the ceiling 13 and of the floor 14, respectively, of the enclosure 1, this deflecting metal sheet being interposed between the turbine 4 and the burner 2.

It should be pointed out that the deflecting metal sheet 14 comprises as well seen on FIG. 2 a grid or the like 15 located at the turbine 4 in order to promote the forced convection of the heated air within the enclosure as shown by arrows on FIG. 1. It should be noted here that the burner 2 in the upper portion of the enclosure 1 is interposed between the deflecting metal sheet 14 and the protecting grid 11 which separates in a way the functional or rear portion of the furnace from the front or cooking portion of this furnace, which forward or front portion is provided with a door 16 and with a window pane 17.

At 18 on FIG. 1 has been diagrammatically shown an instrument board or panel for controlling the furnace and at 19 on FIG. 2 has been shown a pressure controller mounted onto the duct 10.

The floor or bottom wall 14 of the enclosure 1 comprises a condensate discharge opening or port 20.

The ceiling or top wall 13 of the enclosure 1 is provided with a valve 22 providing for the communication of the enclosure 1 with the outer atmosphere.

Figure 4:
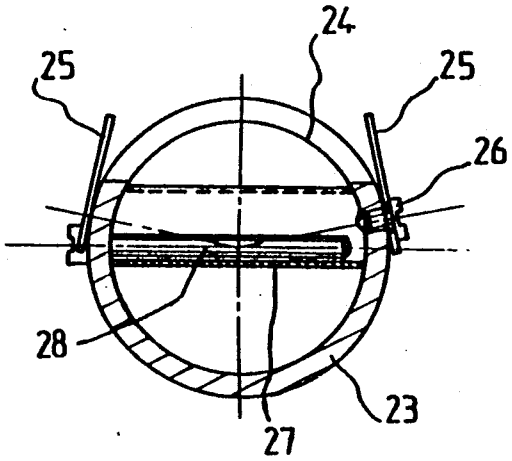
FIG. 4 is a view of this burner in section taken upon the line IV—IV of FIG. 3.

Referring more particularly to FIGS. 3 and 4 it is seen that the burner 2 consists of a tube 23 secured as previously stated to the wall 13 of the enclosure 1 and provided with a plurality of slots 24, there slots being for instance 65 in number and being uniformly distributed over substantially the whole length of the tube 23. These slots 24 extend along a little less than one half of the periphery of the tube 23 as seen on FIG. 4 and are orthogonal to the axis X—X' of said tube.

At 25 are shown deflecting plates secured substantially to the bases of the slots 24 my means of screws 26 for instance. These deflecting plates 25 may as well seen on FIG. 3 consist of a series of plates fastened by screws onto the outer wall of the tube 23. These deflecting plates 25 located substantially at the place where the arcuate slots 24 are extending from provide for an effective piloting of the flames which remain stable.

At 27 on FIGS. 3 and 4 is shown a perforated metal sheet extending inside of the tube 23 along a plane substantially orthogonal to those of the deflectors 25. These perforated metal sheet provides for a good distribution of the flames over the whole outlet passageway section of the burner. The perforated metal sheet 27 is fastened to the tube 23 by means of screws 28 for instance.

The burner which has just been described is provided with electrodes (not shown) for the ignition and the detection of the flames.

Referring back to FIG. 2 it is seen that the duct or pipeline 29 feeding the gas-combustion air mixture to the burner 2 is fitted with a quarter turn valve 30 controlled by a servo-motor (not shown) and advantageously avoiding any migration of humidity in the upstream direction, i.e. towards the gas-combustion air supply system diagrammatically shown at 8, 9 and 10.

For a better understanding of the invention however the operation of the furnace just described will now be set forth.

When the user desires to make a steam cooking the servo-motor actuates the quarter turn valve 30 which would close. The steam may therefore not flow towards the outside via the burner 2 and the pipeline or duct 29, it being understood that the valve 22 is closed. Henceforth any steam over pressure would be discharged through the port 20 provided for the condensates.

If the user wishes to change from the steam cooking to a combined (steam and gas) cooking or to a gas cooking alone and valve 22 would open as well as the quarter turn valve 30 previously closed.

A time-delay device (not shown) then starts the operation of the fan 9 supplying combustion air under pressure which is fed to the burner. Then the ignition and flame detection electrodes are dried as well as the burner which is necessarily in contact with the moist atmosphere prevailing within the enclosure 1 of the furnace.

Therefore one will be sure that the burner could ignite hence operate to continue the cooking.

There has thus been provided according to the invention an improved furnace operating with steam and/or gas and advantageously avoiding any disturbance of the burner by the moisture or humidity owing to this burner being mounted in an elevated and reversed or inverted position, owing to the structure of this burner which is particularly adapted to an operation in a steam atmosphere and owing to a quarter turn valve preventing any migration of the steam towards the system for supplying the burner with a gas-combustion air mixture.

It should be understood that the invention is not at all limited to the embodiment described and shown which has been given by way of exemple only.

Thus the steam generator fitting the furnace according to this invention may be made in any manner whatsoever and comprises for instance a heat exchanger consisting of a plurality of tubes of rectangular cross-section welded to each other along their widths thereby providing a greater compactness with respect to a conventional construction with spaced tubes.

The invention therefore comprises all the technical equivalents of the means described as well as their combinations if the latter are carried out according to its gist and within the scope of the appended claims.

What is claimed is:

1. A furnace for cooking food products with steam and/or gas, the furnace comprising:

an enclosure with a top wall; a gas burner located within the enclosure; a system for supplying a mixture of gas and combustion air under pressure, the system being connected to the burner; a turbine for providing circulation within the enclosure; and a steam generator which is connected to the enclosure;

wherein the burner is mounted at an upper portion of the enclosure, in an inverted position and pointing downwardly with respect to the enclsoure, such that condensates and/or water within the enclosure do not affect the burner;

wherein the burner is formed of a tube with a central axis and slots which extend orthogonally with respect to the central axis, and wherein the tube is secured to the top wall; and wherein at least two deflectors are securd to bases of the slots at the outside of the tube for piloting the flames of the burner, the deflectors extending along planes, and wherein a flame distributing perforated metal sheet extends inside of the tube along a plane which is substantially orthogonal to those of the deflectors.

2. A furnace according to claim 1, further comprising a deflecting metal sheet extending between upper and lower portions of the enclosure and interposed between the burner and the turbine.

3. A furnace according to claim 2, wherein said deflecting metal sheet is provided with a grid at the turbine.

4. A furnace according to claim 1, wherein the mixture of gas and combustion air is conveyed to the burner through a duct fitted with a quarter turn valve operated by a servo-motor.

* * * * *